US005355805A

United States Patent [19]

Haab et al.

[11] Patent Number: 5,355,805

[45] Date of Patent: Oct. 18, 1994

[54] RAIL FOR OVERHEAD TROLLEYS HAVING BAR IN GROOVE CONNECTION FOR CONNECTING ADJACENT RAIL ENDS

[76] Inventors: Karl Haab, Obere Weidstrasse 7, 6343 Rotkruez; Otto Haab, Zurichstrasse 25, 8932 Mettmenstetten, both of Switzerland

[21] Appl. No.: 71,722

[22] Filed: Jun. 3, 1993

[30] Foreign Application Priority Data

Jun. 4, 1992 [CH] Switzerland ..... 01796/92-5

[51] Int. Cl.[5] ..... E01B 25/24

[52] U.S. Cl. ..... 104/106; 238/151; 238/175; 403/292

[58] Field of Search ..... 104/106, 107, 108, 109, 104/110, 111; 238/151, 175, 176, 243, 260, 262; 403/292, 293

[56] References Cited

U.S. PATENT DOCUMENTS

| | | | |
|---|---|---|---|
| 903,594 | 11/1908 | Maddrell | 104/107 |
| 2,193,409 | 3/1940 | Miller | 104/109 X |
| 2,784,813 | 3/1957 | Second et al. . | |
| 3,389,661 | 6/1968 | Wainwright et al. | 104/106 |
| 3,431,585 | 3/1969 | Foltz . | |
| 4,172,423 | 10/1979 | Monne | 104/111 X |
| 5,012,746 | 5/1991 | Bormann et al. | 104/107 X |
| 5,104,040 | 4/1992 | Bormann et al. | 104/111 X |
| 5,203,135 | 4/1993 | Bastian | 403/292 X |

FOREIGN PATENT DOCUMENTS

| | | |
|---|---|---|
| 0457286 | 11/1991 | European Pat. Off. . |
| 8409917 | 3/1984 | Fed. Rep. of Germany . |
| 3910542 | 8/1990 | Fed. Rep. of Germany . |

*Primary Examiner*—Andres Kashnikow
*Assistant Examiner*—S. Joseph Morano
*Attorney, Agent, or Firm*—Egli International

[57] ABSTRACT

Two mutually adjoining profile pieces (1*a*) of equal cross-section are connected by means of a coupling piece (16) which overlaps both of them and is situated in a coupling groove (15). The convexly arched floor of the latter is formed by the underside of a crossbar (5), the top side of which forms a running surface (6) for bearing rollers of running mechanisms. In the downward direction, the coupling groove (15) is limited by lateral holding strips (18*a,b*) exhibiting flat, inwardly inclined holding surfaces (19*a,b*), which point towards the floor of the said coupling groove and against which are pressed corresponding contact strips (20*a,b*) of the coupling piece (16), which coupling piece is braced against the holding strips (18*a,b*) of each of the profile pieces (1*a*), by means of, in each case, two tapping screws (17*b*) pressing against the floor of the coupling groove (15). At the bottom, the coupling groove (15) is adjoined by a guide groove (9) for receiving guide rollers. For the purpose of enabling a particularly stable connection of the profile pieces—for example in the case of a rail supported only punctually by means of sliding blocks, which are disposed in a fastening groove and in which threaded bolts engage—the profile pieces can be provided with two coupling grooves disposed at a distance apart one above the other.

13 Claims, 5 Drawing Sheets

RAIL FOR OVERHEAD TROLLEYS HAVING BAR IN GROOVE CONNECTION FOR CONNECTING ADJACENT RAIL ENDS

BACKGROUND OF THE INVENTION

The invention relates to a rail having at least one running surface for bearing rollers of running mechanisms, which rail is formed by at least two successive profile pieces of equal cross-section, which join together at a junction point, and comprises at least one coupling piece, which overlaps and is connected to two adjoining profile pieces. Each profile piece has, for receiving that part of a coupling piece which overlaps it, a coupling groove, with lateral holding strips, which overlap the coupling piece with holding surfaces, and in that the part of the coupling piece is braced against the holding surfaces by means of at least one threaded pin, which is screwed into a through bore of said coupling piece and presses against the floor of the coupling groove. Rails of this type serve the guidance of running mechanisms which bear sliding doors, for example external and internal doors on buildings and also furniture doors.

The rails comprise a plurality of straight or curved, usually extruded profile pieces of equal cross-section made from metal, generally aluminium. In this case, the connection of successive profile pieces often presents certain difficulties, since the said profile pieces should join together, at the junction points, as exactly congruently as possible, whilst, at the same time, the connection should be able to be created, in the assembly, rapidly and without difficulty.

It is known to connect successive profile pieces by means of tongues which overlap both and are screw-connected to both profile pieces. Such a connection is however awkward in the assembly and requires a plurality of very accurately placed bores.

SUMMARY OF THE INVENTION

The object of the invention is therefore to define a rail of the generic type, in which successive profile pieces can be connected simply, rapidly and precisely.

In the rail according to the invention, as it is characterised in the claims, successive profile pieces can be connected at the junction points very simply—essentially by the tightening of a few screws.

The connection can be easily designed such that the profile pieces join together, at least perpendicular to the running surface, in accurate alignment, so that at the junction point no step appears in the running surface. Steps caused by inaccurate alignment of the profile pieces at the junction point are usually sharp-edged and lead to rapid wear and the destruction of synthetic rollers in running mechanisms. With a view to a long working life for the rollers and a low maintenance requirement for the running mechanisms, it is therefore critically important that steps of this kind should be successfully prevented.

If, in addition, guide surfaces for guide rollers are present, which guide surfaces form an angle with the running surface, then it is necessary to bring the profile pieces exactly to coincidence in two directions. This requirement, too, can be easily fulfilled with the rail according to the invention.

Due to the fact that it teaches a satisfactory connection between rail pieces such as was not previously available, the invention offers very far-reaching advantages insofar as it is now possible to stock not only straight, but also curved rail pieces of specific fixed angles, preferably having straight end pieces, and instead of having, as previously, to create rails having curved sections by welding according to size, to compose the said rails on the spot from prefabricated pieces of this type which, at most, have still to be shortened at the place of installation—which does not present any difficulty.

BRIEF DESCRIPTION OF THE INVENTION

The invention is explained in greater detail below with reference to figures in which illustrative embodiments are represented and in which:

FIG. 1 shows a side view of a rail according to the invention, according to a first embodiment, in the region of a junction point inclusive of a running mechanism, FIG. 2 shows a cross-section through the rail according to the invention, according to a section along the line II—II in FIG. 1, FIG. 2*a* shows, on a somewhat enlarged scale, a detail from FIG. 2, the running mechanism having been omitted, FIG. 3 shows a longitudinal section through a junction point according to a section along the line III—III in FIG. 2, the running mechanism likewise having been omitted, FIG. 4 shows a cross-section through the rail according to the invention according to a second embodiment.

DESCRIPTION OF THE PREFERRED EMBODIMENTS

Figure 1:
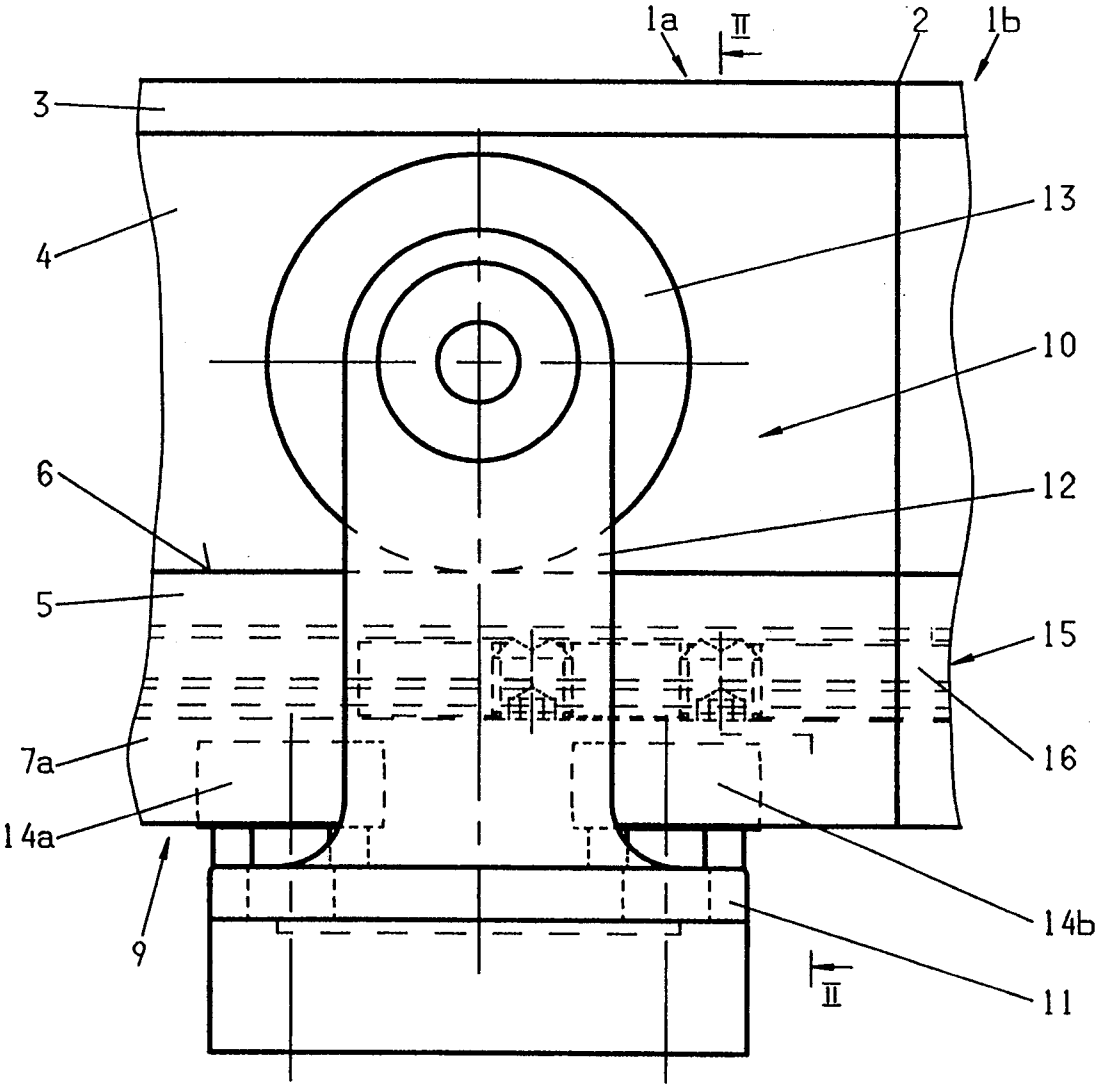
Figure 2:
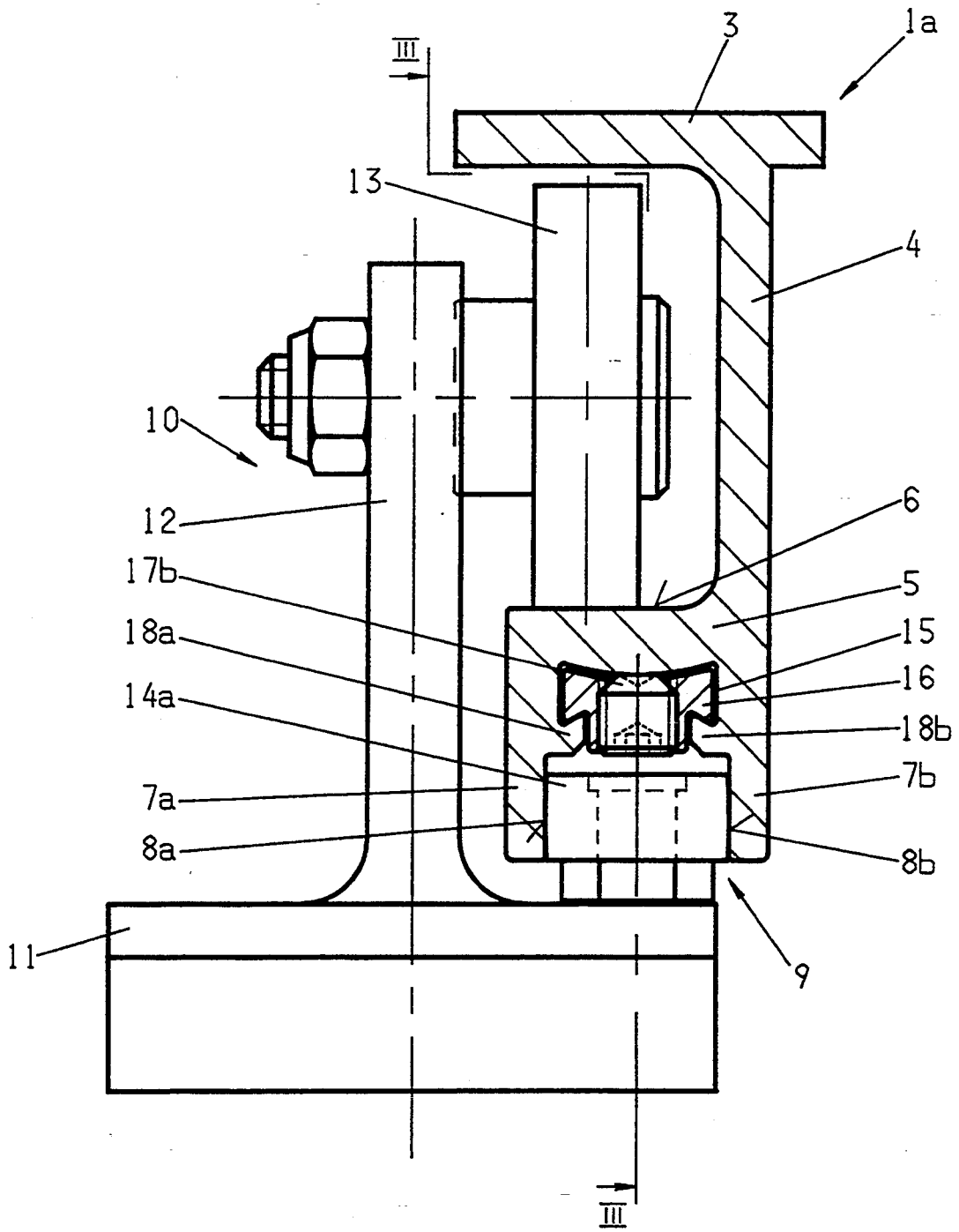

According to a first embodiment of the invention, a rail comprises two profile pieces 1*a*, 1*b*, made from extruded aluminium, which exhibit the same cross-section and join together at a junction point 2. The profile piece 1*a*—the profile piece 1*b* being identically configured—exhibits a fastening flange 3, which is screw-connected to a ceiling or beam or can be otherwise fastened. Adjoining the fastening flange 3, laterally offset, is a vertical bearing flange 4 supporting a horizontal crossbar 5, the surface of which forms a running surface 6 and from which there jut downwards two laterally disposed, parallel guide bars 7*a*, 7*b*, the inner surfaces of which form guide surfaces 8*a*, 8*b* which enclose between them a guide groove 9 (FIG. 2).

The rail serves the guidance of running mechanisms such as the running mechanism 10, which exhibits, on a baseplate 11, a tongue 12, to which a synthetic bearing roller 13 is fastened rotatably about a horizontal axis. Moreover, fitted to the baseplate 11, rotatably about perpendicular axes and spaced apart in the direction of running, are two guide rollers 14*a*,*b*, which engage in the guide groove 9.

From the baseplates 11 of two running mechanisms a door can be hung (not represented), to be more precise, such that the baseplate 11 is in each case rotatable, in relation to the door, about a vertical axis. The running mechanisms are thereby readily able to follow even curved rail sections. The guide rollers 14*a*,*b* in this case not only hold the bearing roller 13 on the running surface 6, but also direct it such that its axis remains everywhere aligned perpendicular to the direction of running.

Figure 3:
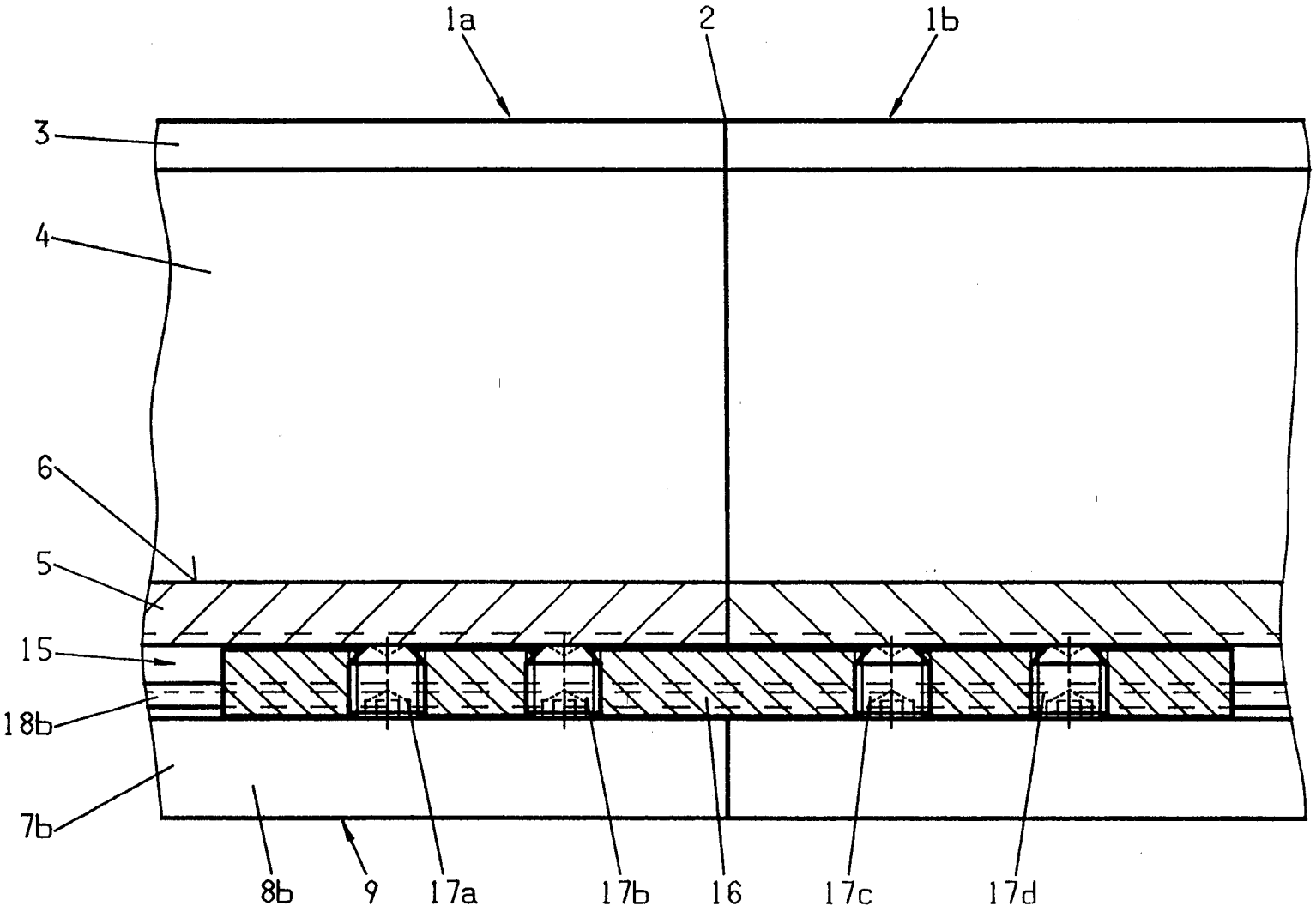

According to the invention, the profile piece 1*a* exhibits above the guide groove 9 a coupling groove 15, which is likewise limited laterally by the guide bars 7*a,b* and which receives, in the region of the junction point 2, an elongated coupling piece 16. The floor of the coupling groove 15, which is convexly arched, is formed by the underside of the crossbar 5 and is approximately parallel to the running surface 6 to which it lies opposite. The coupling piece 16 exhibits four bores, which are directed perpendicularly towards the floor of the coupling groove 15 and hence perpendicularly to the running surface 6 and into which tapping screws 17*a,b,c,d* are screwed (FIG. 3), the cup points of which press against the floor of the coupling groove 15. That part of the coupling piece 16 overlapping one of the profile pieces 1*a,b* is herewith connected to the said profile piece, respectively, by means of two tapping screws 17*a,b* or 17*c,d*.

Figure 2A:
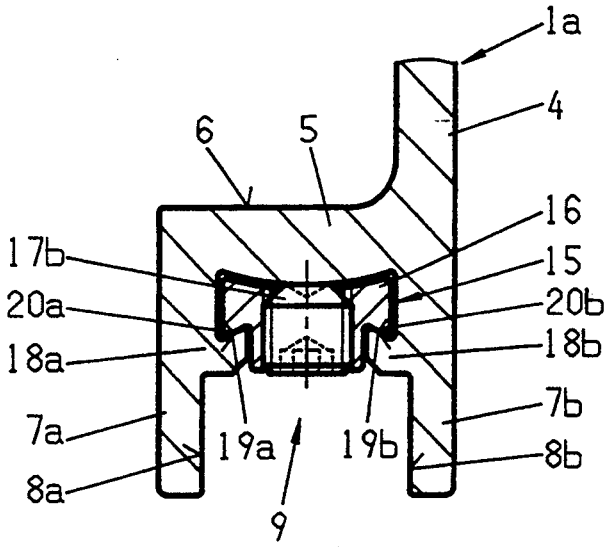

The coupling piece 16 is thus braced against lateral holding strips 18*a,b*, which limit the coupling groove in the downward direction and reach over the coupling piece 16, to be more precise, the surfaces of the holding strips 18*a,b* which point towards the floor of the coupling groove 15 and which form flat holding surfaces 19*a,b* inclined somewhat inwards in the counter direction, that is to say towards the floor of the coupling groove 15, press against correspondingly configured contact strips 20*a,b* on the underside of the coupling piece 16 (FIG. 2*a*). This type of connection ensures, under the easily fulfillable condition that the distance between the holding surfaces 19*a,b* and the running surface 6 is equal in respect of the two profile pieces 1*a* and 1*b*, and that the running surface does not exhibit a step at the junction point 2.

The freedom from steps of the running surface is herewith already assured by the fact that the forces acting between the holding surfaces 19*a,b* of the profile pieces 1*a,b* and the contact strips 20*a,b* of the coupling piece 16, which forces take care of the alignment of the profile pieces 1*a* and 1*b* relative to the coupling piece 16, exhibit a component perpendicular to the running surface 6, this being achieved, in particular, by a corresponding alignment of the axes of the tapping screws 17*a,b,c,d*.

In the represented case, guide surfaces 8*a,b* are also however present, which form a right angle with the running surface 6 and for which a step-free crossover at the junction point 2 is likewise intended to be guaranteed. This calls for the profile pieces 1*a,b* to join together exactly congruently at the junction point 2 and for their relative position transversely to the direction of running to be precisely controlled, both in the vertical and in the horizontal direction.

This is achieved by the counter-directional inclinations of the holding surfaces 19*a,b* and the corresponding inclinations of the contact strips 20*a,b*, which result in the coupling piece 16 being precisely centred in relation to each of the two profile pieces 1*a,b*. An exact, mutual alignment of the latter, in the horizontal direction also, is thereby achieved, thereby ensuring that the guide surfaces 8*a,b* also join together in a step-free manner, provided only that the said guide surfaces, in the case of the two profile pieces 1*a,b*, are respectively identically positioned in relation to the coupling groove 15.

The tapping screws 17*a,b,c,d*, when they cut somewhat into the aluminium profile pieces 1*a,b*, form a very secure connection between the said profile pieces and the coupling piece 16, in particular preventing a mutual slippage in the direction of running and thereby ensuring that no gap is formed between the profile pieces 1*a,b* at the junction point 2.

The represented configuration, in which the coupling groove 15 is disposed directly beneath the running surface 6 and the guide groove 9 adjoins the coupling groove at the bottom, is not only particularly space-saving but also has the advantage that those sections which ensure the accurate alignment of mutually adjoining profile pieces and those sections whose precise fitting together is particularly important, are situated geographically close to one another, so that this fitting together can scarcely be adversely affected by deformations or production tolerances.

Figure 4:
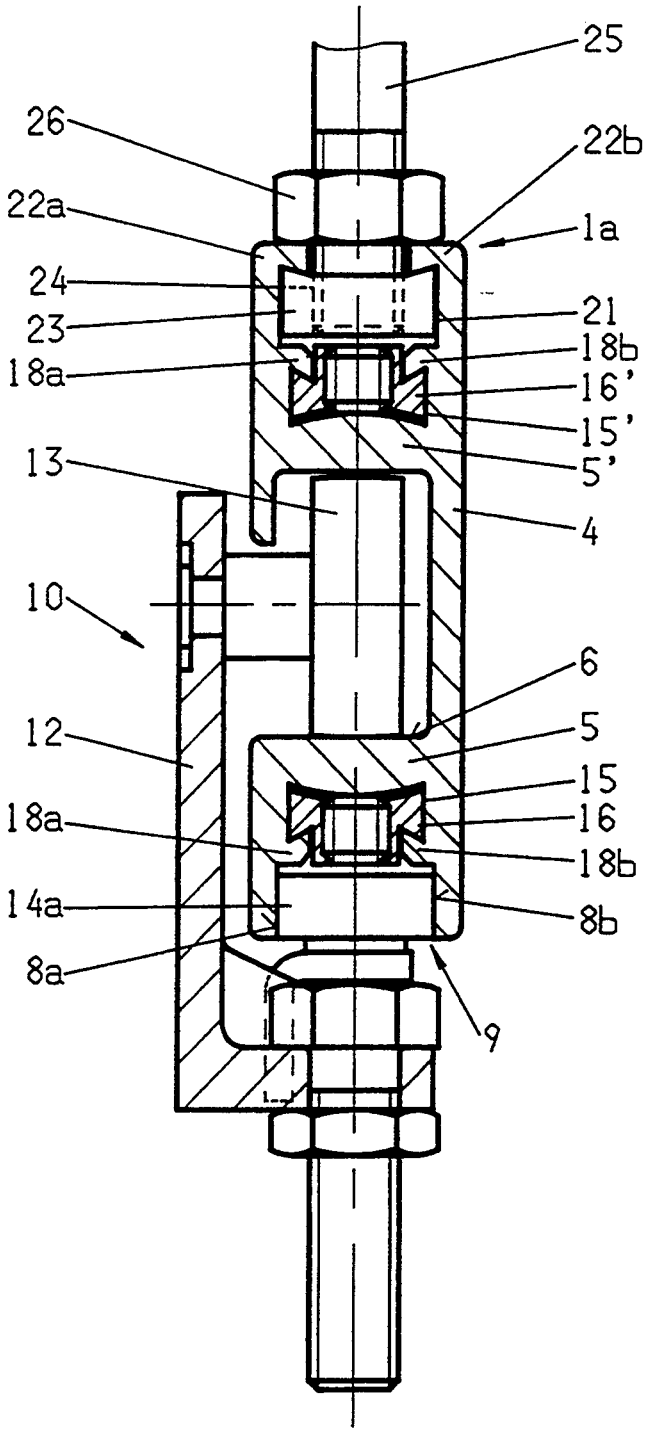

According to the second embodiment, represented in FIG. 4, the profile piece la exhibits a second crossbar 5', which projects from the bearing flange 4 above the running surface 6 parallel to the crossbar 5 and to the top side of which there is fitted, in the region of a junction point, an upwardly open, second coupling groove 15' for receiving a second coupling piece 16'. The second coupling groove 15' and the first coupling groove 15 are disposed mutually offset in the vertical direction, preferably directly one above the other and—just like the coupling pieces—16, 16'—are configured the same as in the first embodiment. As a result of the second coupling point, the connection of the profile pieces acquires particularly high stability and strength.

This is of critical benefit, particularly if the rail is not fastened continuously—for example, by means of a fastening flange—but only at relatively large intervals. The profile piece 1*a* is prepared for a fastening of this type by a fastening groove 21, which is fitted to its top side and is laterally overhung by fastening strips 22*a,b*. The fastening groove 21 is disposed, particularly favourably and in a space-saving manner, directly above the second coupling groove 15'.

The rail can be hung from sliding blocks 23, which are inserted in the fastening groove 21 and respectively exhibit a threaded bore 24, in which a threaded bolt 25 engages. The threaded bolt 25 supports, above the sliding block 23, a nut 26, in such a way that the fastening strips 22*a,b* can be clamped between the said nut and the sliding block 23 and the said sliding block can thus be connected, non-displaceably, to the profile 30 piece 1*a*, whereas, when the nut 26 is loosened, the profile piece 1*a* and the sliding block 23 are mutually displaceable.

We claim:

1. A rail having at least one running surface for bearing rollers of running mechanisms, which rail is formed by at least two successive profile pieces of equal cross-section, which join together at a junction point, and comprises at least one coupling piece, which overlaps and is connected to said profile pieces, wherein each profile piece has, for the reception of a part of said at least one coupling piece which overlaps it, a coupling groove, having lateral holding strips, which overlap the coupling piece with holding surfaces, and in that the said part of the coupling piece is braced against the holding surfaces in each case by means of at least one threaded pin, which is screwed into a through bore of said coupling piece and presses against the floor of the coupling groove and, wherein the holding surfaces are plane and are counter-directionally inclined and interact with flat contact strips on the coupling piece, which contact strips respectively exhibit a corresponding inclination.

2. The rail of claim 1, wherein the axes of the threaded pins respectively form a positive angle with the running surface.

3. The rail of claim 1, wherein the coupling piece is respectively braced, by means of at least two threaded pins, with each of the two profile pieces which it overlaps.

4. The rail of claim 1, wherein the holding surfaces are inclined towards the interior of the coupling groove.

5. The rail of claim 1, wherein the floor of the coupling groove is convexly arched.

6. The rail of claim 1, wherein the threaded pins are configured as tapping screws.

7. The rail of claim 1, having at least one guide surface for guide rollers, which guide surface forms a positive angle with the running surface.

8. The rail of claim 7, having beneath the coupling groove an adjoined guide groove, the lateral limit surfaces of which form said at least one guide surface.

9. The rail of claim 1, wherein the running surface is formed by the top side of a horizontal crossbar, the underside of which forms the floor of the coupling groove.

10. The rail of claim 1, wherein each profile piece has at least a second coupling groove, disposed above the first coupling groove, for receiving a second coupling piece.

11. The rail of claim 10, wherein a second coupling groove is disposed on the top side of a crossbar and above the running surface.

12. The rail of claim 1, wherein at least one said profile piece exhibits, on its top side, an upwardly open fastening groove, overhung laterally by fastening strips, for receiving sliding blocks.

13. The rail of claim 12, wherein a fastening groove is disposed directly above a second coupling groove.

* * * * *